US006435280B1

(12) United States Patent
Van Wechem et al.

(10) Patent No.: US 6,435,280 B1
(45) Date of Patent: Aug. 20, 2002

(54) MAKING AND BREAKING OF COUPLINGS BETWEEN PIPE SECTIONS IN A DRILLING RIG

(75) Inventors: Gustaaf Louis Van Wechem, Reeuwijk; Thomas Walburgis Bakker, Vries, both of (NL)

(73) Assignee: Well Engineering Partners B.V., Vries (NL)

( * ) Notice: Subject to any disclaimer, the term of this patent is extended or adjusted under 35 U.S.C. 154(b) by 0 days.

(21) Appl. No.: 09/582,571

(22) PCT Filed: Dec. 24, 1997

(86) PCT No.: PCT/NL97/00727

§ 371 (c)(1),
(2), (4) Date: Sep. 5, 2000

(87) PCT Pub. No.: WO99/34089

PCT Pub. Date: Jul. 8, 1999

(51) Int. Cl.[7] ..... E21B 19/16

(52) U.S. Cl. ..... 166/377; 166/77.53; 166/380; 175/85

(58) Field of Search ..... 166/377, 378, 166/379, 380, 77.53, 77.4; 175/85

(56) References Cited

U.S. PATENT DOCUMENTS 2,126,933 A * 8/1938 Stone et al. ..... 166/77.4
2,450,934 A * 10/1948 Calhoun ..... 166/77.53
3,096,075 A * 7/1963 Brown ..... 254/29 R
3,144,085 A 8/1964 Hasha
3,212,578 A 10/1965 Hasha
3,282,339 A 11/1966 Hasha
3,706,347 A 12/1972 Brown
3,708,020 A 1/1973 Adamson
4,567,952 A * 2/1986 Lemaire et al. ..... 173/164
4,591,007 A * 5/1986 Shaginian ..... 175/85
4,974,686 A * 12/1990 Hisey et al. ..... 173/164
5,297,833 A 3/1994 Willis et al.
5,791,410 A * 8/1998 Castille et al. ..... 166/77.1
6,206,096 B1 * 3/2001 Belik ..... 166/77.51

* cited by examiner

*Primary Examiner*—Hoang Dang
(74) *Attorney, Agent, or Firm*—Kinney & Lange, P.A.

(57) ABSTRACT

For making of breaking a coupling between a pipe section (1) and a pipe string (2) projecting from a rotary drilling rig into a bore in the lithosphere, the pipe section (1) is rotated relative to the pipe string (2) by applying a torque up to a make-up or breaking torque. Exertion of said torque generates a reactive torque in an opposite sense of rotation. Rotation induced by a motor (17; 50) is transferred to the pipe string (2) so that said pipe string (2) is rotated as well. The reactive torque is transferred to the pipe string (2) along a path bypassing the motor (17; 50). Thus, the make-up or breaking torque can be exerted without requiring a substantial change of the torque exerted to rotate the pipe string (2) at a constant rotational velocity in order to avoid changes of the rotational velocity of the pipe string (2). A pipe coupling device and a pipe handler for carrying out this method are described as well.

11 Claims, 4 Drawing Sheets

MAKING AND BREAKING OF COUPLINGS BETWEEN PIPE SECTIONS IN A DRILLING RIG

TECHNICAL FIELD

The invention relates to the making and breaking of connections between pipe sections and a pipe string projecting from a drilling rig in a bore hole in the lithosphere, for instance in the course of drilling or lining oil or gas wells.

BACKGROUND ART

Drilling for oil or gas and lining of the well typically involves the introduction of a large number of pipe sections or stands such as drill pipe sections and casing pipe sections into the well. The sections are each time connected to a string of sections projecting into the well after having been brought into line with the pipe string. Each section may be formed by a single joint or by a plurality of joints which have been connected to each other before being connected to the string.

During drilling, the string is typically rotated while mud is being fed to the string for instance to drive a mud motor of a drill bit at the extreme end of the string. Mud can also be fed to facilitate introduction of the string into the bore hole. It is also known to rotate a casing string during insertion into a bore hole.

Couplings between successive pipe sections are typically made or undone by screwing the pipe sections onto the string or unscrewing the pipe sections from the string. To reduce the number of rotations requires to make or break a connection, the mating threads of the couplings are usually of a generally conical shape. The spinning of each section to be connected or removed is typically carried out after having stopped rotation of the string. Tongs such as Wheatherford tongs or a so-called Iron Roughneck are used to spin each pipe section to be connected and to exert the final or initial torque required to make or, respectively, break the connection.

The efficiency and effectivity of such operations is substantially impaired by the interruption of the drilling or lining process required to connect or disconnect the next section. This is of particular importance, because the drilling of a bore hole typically involves a plurality of tripping operations (extracting and re-introducing the string) for inspection and/or replacement of the drill bit. Each tripping operation includes the disconnection and connection of about 50–300 sections. More specifically, stopping the rotation of the string has various adverse effects; such as unwinding if the pipe string is a drill string. After rotation of a drill string has been restarted, it typically takes 10–30 minutes before a reasonably stable operating equilibrium is reached. Moreover, stopping rotation of a string in a bore hole increases the risk of the string getting stuck in the bore hole. As such, the period between stopping the string and restarting the string adds to the time required to couple or remove a pipe section as well.

It is known from U.S. Pat. No. 3,708,020 to Adamson to keep a small drill string for taking cores of geological formations or concrete rotating while drill pipe connections are made or released. However, the exertion of torques to make or break the connections between successive lengths of drill pipe disturbs the operating equilibrium of the rotating drill string, which adversely affects the rate of progress and the tool life of the drill bit.

SUMMARY OF THE INVENTION

It is an object of the present invention to provide a possibility to reduce the time required to add or remove pipe string sections and to allow the connection between successive sections of the pipe string to be made while substantially reducing the extent to which the operating equilibrium of a rotating string in a bore hole is disturbed.

According to the present invention, this object is achieved by providing a method for making or breaking a coupling between a pipe section and a pipe string projecting from a rotary drilling rig into a bore hole in the lithosphere, in which the pipe section is rotated relative to the pipe string by applying a torque up to a make-up or breaking torque, exertion of that torque generates a reactive torque in an opposite sense of rotation, wherein rotation imparted by a motor is transferred to the pipe string so that the pipe string is rotated as well, and wherein the reactive torque is transferred to the pipe string along a path bypassing the motor.

Another embodiment of the invention for achieving this object is formed by a pipe coupling unit for at least coupling or uncoupling a pipe section and a pipe string axially projecting from a rotary drilling rig into a bore hole in the lithosphere. This pipe coupling unit is provided with:

- a pipe string engaging structure for engaging the pipe string;
- a pipe section engaging structure for engaging the pipe section, the pipe section engaging structure being coaxial with and rotatable relative to the pipe string engaging structure and in a position axially different from the position of the pipe string engaging structure;
- a rotationally stationary support structure rotatably supporting the pipe string engaging structure;
- a pipe string drive including a drive motor operatively coupled to the pipe string engaging structure and to the rotationally fixed support structure for driving rotation of the pipe string engaging structure relative to the rotationally fixed support structure; and
- a pipe section drive for driving rotation of the pipe section engaging structure relative to the pipe string engaging structure with a torque up to a required make-up or breaking torque, which pipe section drive being arranged for transferring a reactive torque in response to the torque up to a required make-up or breaking torque to the pipe string engaging structure along a transfer path bypassing the motor for driving rotation of the pipe string engaging structure.

Thus, the make-up or breaking torque is or can be exerted in a manner which substantially reduces the extent to which the operating equilibrium of the string rotating in the bore hole is disturbed.

According to particular modes of carrying out the invention, the pipe section to be coupled to the pipe string is gradually accelerated to substantially a rotational velocity at which the pipe string is rotating before the make-up or breaking torque is applied and/or before an engaging structure for applying the make-up torque to the pipe section are brought in engagement with the pipe section. Thus disturbances of the operating equilibrium of the rotating pipe section are further reduced.

Further objects, modes, embodiments and details of the invention appear from the dependent claims and the description in which reference is made to the drawings.

MODES FOR CARRYING OUT THE INVENTION

Figure 1:
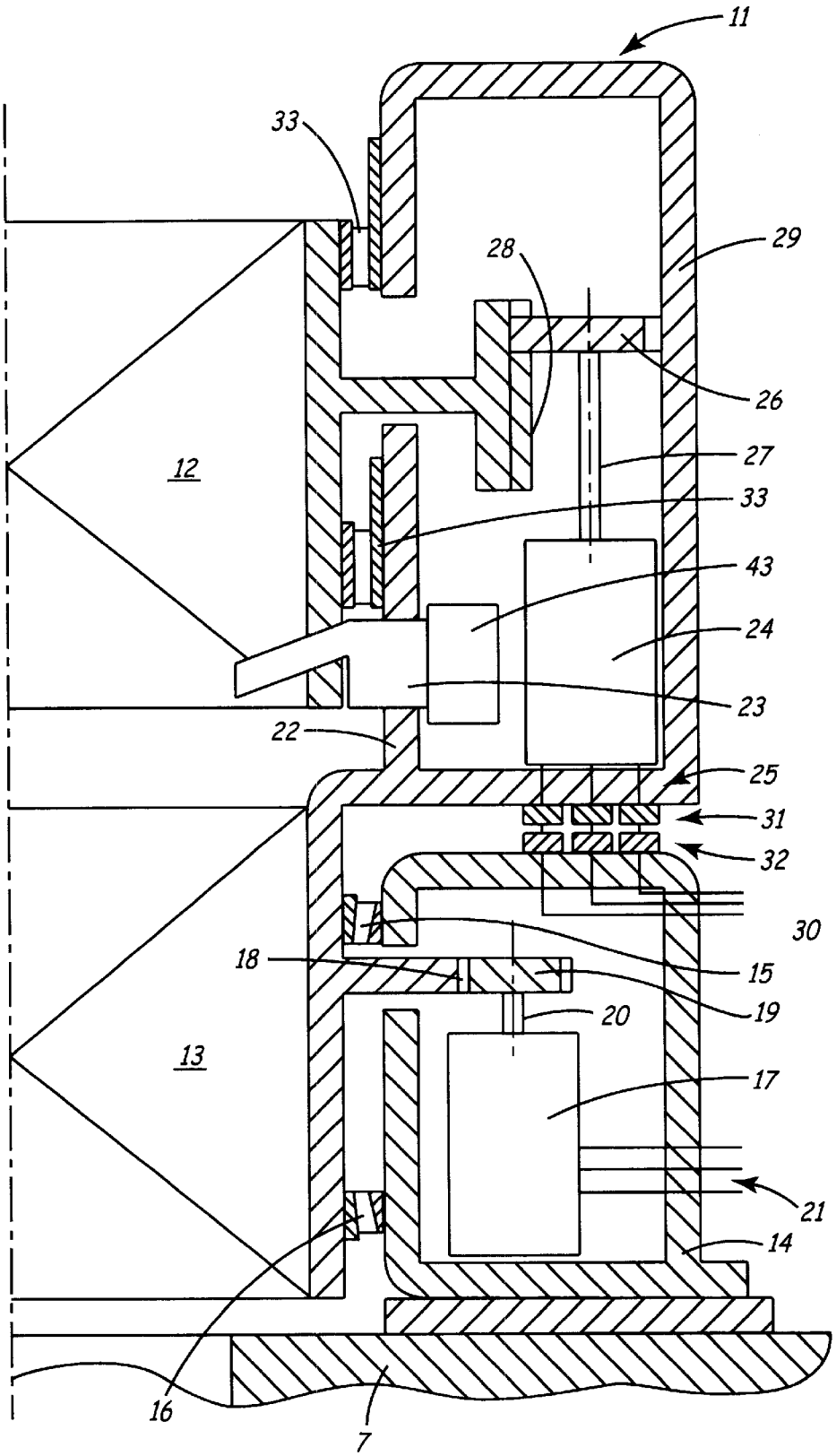
FIG. 1 is a cross-sectional side view of a half of an example of a pipe coupling unit according to the invention.

In FIGS. 2–7 a presently most preferred example of a rotary drilling rig for drilling into the lithosphere and more in particular for drilling and lining oil and gas wells is schematically depicted in successive stages of an operation of adding a pipe section 1—in this case a single joint pipe section—to a pipe string 2. Further pipe section 1' and 1" are stored in a pipe section dispenser 3 aside the pipe string 2.

The drilling rig has a well head 4. Above the well head a lower drilling table 5 is mounted on leg structures 6 and vertically movable between heights of about 11 and 17 m above terrain level by changing the effective length of the leg structures 6. The leg structures 6 include hydraulic cylinders and guide means separate thereof, which cylinders and guide means are known constructional details and therefore not shown or described. Other known linear transmission systems for driving movement in the direction of the pipe string, such as cable hoists and screw transmission systems, can be used as well. Above the lower drilling table 5 an upper drilling table 7 is mounted on leg structures 8 similar to the leg structures 6 of the lower drilling table 5 and vertically movable as well in essentially the same manner between heights of about 23 and 30 m above terrain level. Of course, other height ranges within which the tables can be moved can be selected in accordance with requirements regarding the lengths of the pipe sections 1.

Instead of tables movable by leg structures (for instance with hydraulic or screw drives), it is also possible to achieve the lift function in different manners, for instance by using a cable hoist system with a guide for the drilling tables. However, the use of legs for lifting and lowering the drilling tables is particularly suitable for drilling in a slanting or even horizontal orientation.

The lower drilling table 5 carries a rotatable clamp 9 from which the pipe string 2 (typically having a mass of at least 300,000 to 500,000 kg when at maximum length) can be suspended releasably. The clamp 9 is connected to a drive 10 for driving rotation of the pipe string 2 and can transfer a driving torque of about 15,000–25,000 Nm. Coaxially with the clamp 9, a passage through the clamp 9 and the lower drilling table 5 is provided through which passage the pipe string 2 extends when the rig is in operation. The design of the clamping section of the clamp 9 can in principle be similar to that of conventional spiders for stationary mounting on a rig floor. The drive 10 for driving rotation of the clamp 9 is of a design equal to the portion of the drive assembly in FIG. 1 which serves for driving rotation of a pipe string clasping structure 13 relative to the drill table 7.

The upper drilling table 7 carries a pipe coupling unit 11 of which a presently most preferred example is shown in more detail in FIG. 1. The pipe coupling unit 11 has a pipe section clasping structure 12 for engaging the pipe section 1. Coaxial with the pipe section clasping structure 12 and in a position axially different from the position of the pipe section clasping structure 12 there is provided a pipe string clasping structure 13 for engaging the pipe string 2. The design of the pipe section clasping structure 12 can for instance be essentially identical to that of the wrench of a conventional device for the make-up and break-out of pipe string connections and is therefore not shown or described. The pipe string clasping structure 13 can for instance be essentially identical to that of a known spider or elevator with active power-assisted clamping to ensure sufficient traction also if the pipe string is still short and therefore has a little weight. Preferably, both clasping structures are capable of transferring a make-up torque of up to 50,000 to 120,000 Nm to the respective engaged pipe portions. The pipe section clasping structure 12 should preferably be capable of retaining pipe sections against axial loads of at least 2,500 to 3,000 kg. The pipe string clasping structure 13 should be able to carry the whole weight of a pipe string suspended in a bore hole, which can be up to about 500,000 kg when the pipe string is at its full length.

The pipe string clasping structure 13 is rotatably supported by a rotationally stationary support structure 14, bearings 15, 16 being provided between the pipe string clasping structure 13 and the stationary support structure 14. The stationary support structure 14, in turn, is mounted to the upper drilling table 7.

For rotating the pipe string clasping structure 13, a pipe string drive including a drive motor 17 coupled to the pipe string clasping structure 13 and to the rotationally fixed support structure 14 is provided. The pipe string drive further includes a toothed ring 18 provided on the pipe string clasping structure 13 and a gear wheel 19 meshing therewith and fixed to the drive shaft 20 of the motor 17. The motor 17 is an electromotor connected to power cables 21.

The pipe section clasping structure 12 is rotatably supported relative to the pipe string clasping structure 13 by a flange 22 integrally connected to the pipe string clasping structure 13 and lift pawls 23 projecting inwardly from the flange 22. To drive the rotation of the pipe section clasping structure 12 relative to the pipe string clasping structure 13, a pipe section drive including an electromotor 24 connected to power cables 25, a gear wheel 26 mounted to a drive shaft 27 of the electromotor 24 and a circular toothed flange 28 is provided. The drive is mounted in a support housing 29 integrally formed with the flange 22 and accordingly rotatable in unison with the pipe section clasping structure 12.

For feeding power to the electrometer 24, the power cables are connected to stationary power cables 30 via sliding contacts 31, 32 on the support housing 29 and on the stationary support structure 14, which contacts 31, 32 co-operate along circular tracks.

To facilitate rotation and axial displacement of the pipe section clasping structure 12 relative to the support housing 29, even at high torques, cylindrical sleeve bearings 33 are provided between the pipe section clasping structure 12 and the support housing 29. Because relative axial movements of the cylindrical bearing surfaces in accordance with the pitch of the coupling members is required only when relative rotational movement occurs, substantially no additional friction has to be overcome to obtain the required axial movement.

The motor 24 is selected to generate a torque up to a required make-up torque and, in the opposite sense of rotation, up to a required break-up torque. It is observed that if, for instance, quarter turn connections are used, the rotatability of the pipe section clasping structure 12 relative to the pipe string clasping structure 13 can be limited to slightly more than a quarter turn, if the sections can be rotationally aligned with the pipe, and to slightly more than a half turn if the pipe sections are engaged in random rotational positions. Accordingly, the toothed flange 28 need not form a full circle about the pipe section clasping structure 12.

The motor 24 of the pipe section drive is fixed to the support housing so that a reactive torque in response to the make-up or break-up torque is transferred directly to the pipe string clasping structure 13 while bypassing the motor 17 for driving rotation of the pipe string clasping structure 13. Thus, the torque exerted for rotating a proximal pipe section relative to the pipe string has no substantial influence on the rotational velocity of the pipe string. Side effects caused by accelerations and decelerations of the pipe section are relatively small and can for a major part be compensated by a quite simple speed control of the motor 17. A particular advantage is that the motor 17 is not loaded with the relatively large make-up torque, which increases its life span and generally allows selecting a less powerful motor.

Since a second motor 24, separate from the first motor 17 for driving rotation of the pipe string clasping structure, is included in the pipe section drive for rotating the pipe section 1 with a torque up to the make-up or breaking torque, particularly little influence of the coupling operating onto the rotational velocity of the pipe string 2 is obtained.

As this second motor 24 is supported by a support structure 29 connected to the pipe string clasping structure 13 for rotation in unison therewith, a simple and effective construction is provided for transferring the reactive torque to the pipe string 2.

Figure 2:
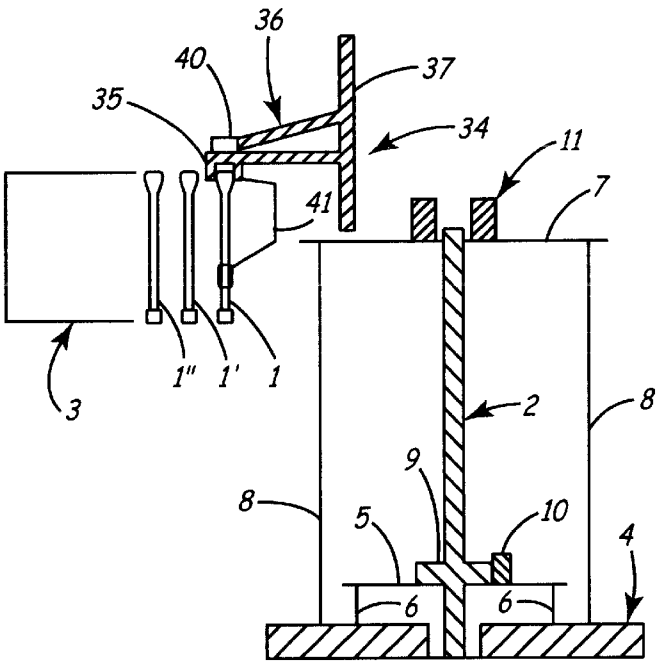
Figure 7:
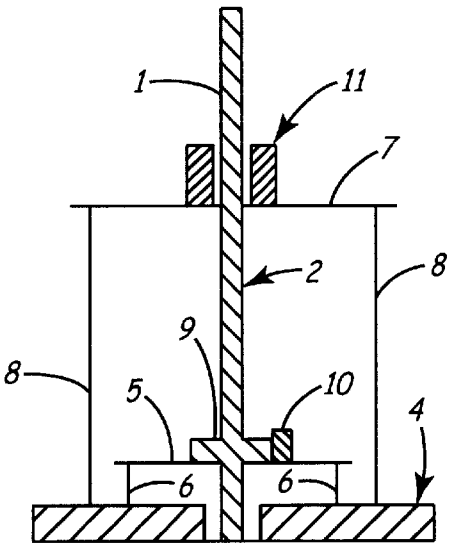

In operation, adding a pipe section 1 to a pipe string 2 starts with the picking up of a pipe section 1 from the dispenser 3. For this purpose and for transferring pipe sections 1 from the dispenser 3 to the proximal end of the pipe string 2 projecting into a bore hole in the lithosphere and vice versa, a pipe handler 34 is provided (FIG. 2). This pipe handler 34 includes a pipe section engagement structure 35 for releasably engaging pipe sections to be transferred. To guide and drive the pipe section engagement structure 35 between a position adjacent the dispenser 3 and a position and orientation in line with the pipe string 2, a lift unit 36 is provided which is guided by vertical guide rails 37 and which has an arm 38 pivotable about the guide 37. The dispenser 3, the carriage 36 and the rails 37 are shown in FIG. 2 only, but are to be considered as included in FIGS. 3–7 as well.

The pipe section handler 34 further includes a drive, schematically depicted by square 40 connected to the pipe section engagement structure 35 for driving rotation of that pipe section engagement structure 35. According to the present example, the drive 40 is of essentially the same design as that of a conventional Iron Roughneck which can be moved laterally towards a pipe section and engaged thereto and vice versa. However, the skilled person will appreciate that many other possibilities of driving rotation of the pipe section engagement structure 35 of the pipe section handler 34 are possible.

The pipe section handler 34 further includes a stabilizing arm 41 projecting under the pipe section engagement structure 35 and having a gripper 42 adjacent its lower end. This arm serves to counteract pendular motion of a pipe section 1 retained in the pipe section engagement structure 35.

While the pipe section is being transferred from the dispenser 3 to the proximal (in this case upper) end of the pipe string 2, rotation and axial displacement of the pipe string 2 is continued. Initially, just after a previous pipe section has been connected, the pipe string is driven by the rotating spider clamp 9 on the lower drill table 5. The upper end of the pipe string 2 is guided by a topmost guide (not shown) and guided by the vertical guide 37 as well. This situation is schematically shown in FIG. 2. For further details regarding the topmost guide, reference is made to applicant's co-pending PCT application entitled "Mud Circulation for Lithosphere Drilling", PCT/NL97/00726, WO 99/34091, published Aug. 7, 1999, and having the same filing date as the present invention.

Figure 3:
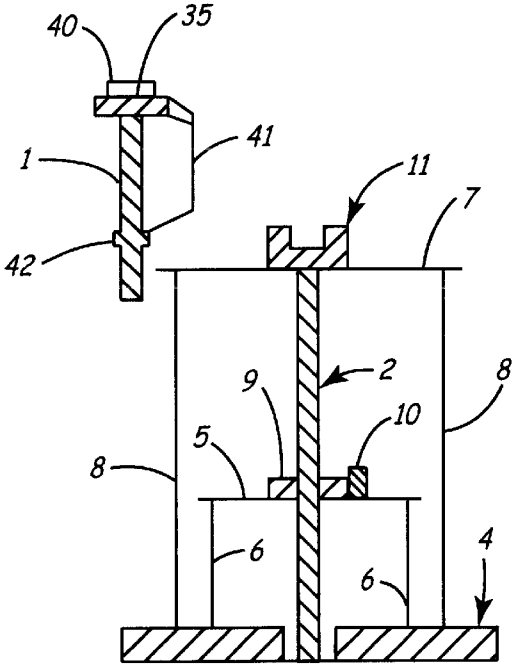

Just before the lower drill table 5 has reached its lowest position, the pipe string clasping structure 13 is brought into engagement with the proximal end of the pipe string 2 and takes over the function of driving the pipe string 2. Subsequently, the lower drill table 5 is returned to its upper take-over position. This situation is schematically shown in FIG. 3.

Figure 4:
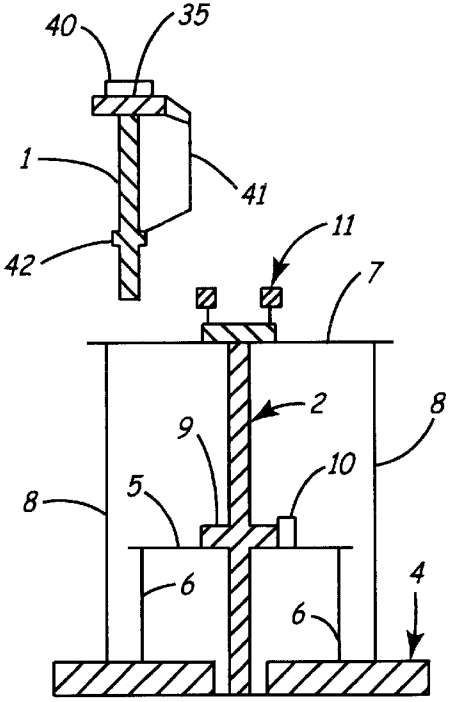
FIGS. 2–7 are schematic side views representing successive stages of the method according to the invention.

As is shown in FIG. 4, the drill tables 5, 7 are gradually lowered while the pipe section 1 is transferred to a position in line with the pipe string 2. Rotation of the pipe string is driven by the motor 17 of the pipe coupling unit, which advantageous, because the need of a top drive for rotating the pipe string is obviated. Lowering of the lower drill table 5 may also be postponed until just before the pipe string 2 is engaged by the clamp 9 on the lower drill table 5.

Figure 5:
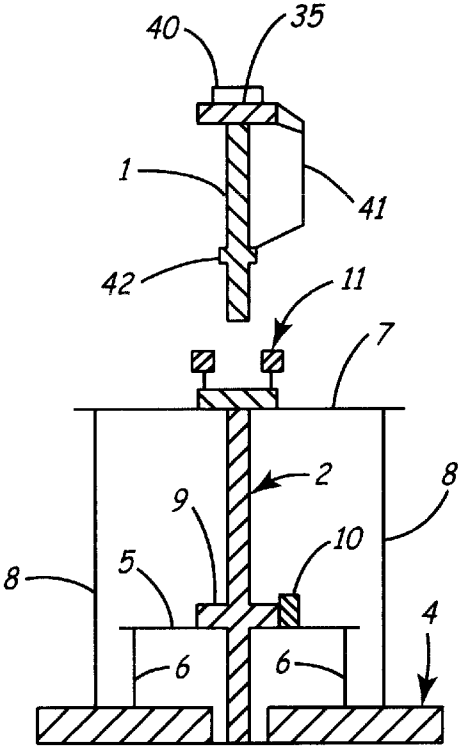

In FIG. 5, the pipe section 1 has reached a position in line with the pipe string 2 but still remote therefrom. In this situation, the pipe section clasping structure 12 is lifted to a position spaced from the pipe string clasping structure 13 by moving the pawls 23 radially inward using drive units 43 (FIG. 1). To allow horizontal drilling as well, the drive units are of a double acting type, i.e. capable of controlling movements of the pawls 23 against inward and outward loads.

Figure 6:
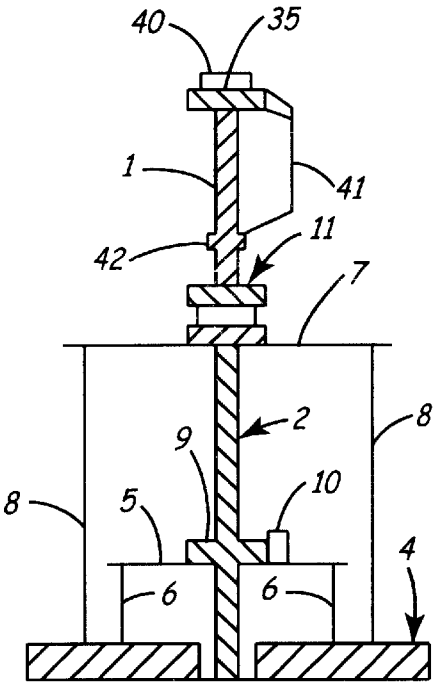

From that position, the pipe section 1 is lowered until its lower coupling end is introduced into the pipe section clasping structure 12 (FIG. 6). To avoid damage to the coupling ends, the internal shape of the pipe section clasping structure 12 is preferably such that it prevents the pipe section from passing below a predetermined level in the pipe section clasping structure 12. When the pipe section 1 has reached its desired level, the pipe section clasping structure 12 is operated to engage the pipe section 1 and the pipe section equipment structure 35 of the pipe handler is released from the pipe section 1. Subsequently, the pipe coupling unit rotates the pipe section 1 relative to the pipe string 2 to make the connection between these parts.

Because the pipe section 1 to be coupled to the pipe string 2 has been accelerated to substantially the same rotational velocity as the rotational velocity of the pipe string 2 before the pipe section to be coupled is engaged or at least the make-up or breaking torque is applied, wear of the pipe section clasping structure 12 is substantially reduced. Since the velocity difference which the pipe section 1 to be coupled has to overcome is relatively small, disturbances of the continuous rotation of the string 2 due to inertia of the accelerated new pipe section 1 are substantially reduced as well. Such small disturbances can be cancelled out using so-called soft-torque drive controls, which are known in practice.

Then, the pipe section drive motor 24 is activated to rotate the pipe section 1 relative to the pipe string 2 by applying a torque up to a preset make-up torque. Preferably, changes in rotational velocity of the pipe section to be connected are carried out smoothly, to facilitate avoiding disturbances of the equilibrium of the string rotating in the bore hole, for instance by anticipating forces exerted due to acceleration or deceleration and the rotational inertia of the pipe section to be connected or disconnected. Exertion of that torque generates a reactive torque in an opposite sense of rotation. The reactive torque is transferred directly to the pipe string 1 so that the motor 17, which drives the pipe string 2 continuously during the drilling or lining process, is bypassed and continuous rotation of the pipe string 2 is not substantially influenced by the exerted make-up torque.

While the pipe section 1 to be connected is rotated relative to the pipe string, the pawls 23 having bevelled ends are gradually retracted at a pace corresponding to the pitch of the mating coupling ends, so that the pipe section is gradually lowered at a pace corresponding to the pitch of the mating coupling ends as well and axial loading of the weight of a pipe section onto the coupling before it has been completed is avoided.

After the connection has been made, the rotating spider clamp 9 is brought into engagement with the pipe string 2 and takes over the function of driving and carrying the pipe string 2 from the pipe coupling unit 11. Subsequently, the pipe handler 34 is moved away from the pipe string 2 in a direction radial to the string 2. The upper drilling table 7 carrying the pipe coupling unit 11 is moved upward along the added pipe section 1.

Thus, subsequently to the coupling of a pipe section 1 to a pipe string 2, the pipe coupling unit by which the make-up torque has been applied is axially moved towards a proximal end of the pipe string 2 lengthened by the added pipe section 1 and subsequently engages that proximal end of that lengthened pipe string 2 and exerts the reactive torque on the lengthened pipe string 2 upon coupling of a next pipe section 1 to the lengthened pipe string 2.

This provides the advantage that the clasping structures 12, 13 of the pipe coupling unit 11 can remain located around the pipe string 2. In turn, this obviates the need of a side gate allowing the string and the clasping structures 12, 13 to move laterally into and out of engagement, and allows clasping structures of the pipe coupling unit to be of a closed ring structure fully encircling a passage for receiving a pipe to be engaged. Thus, the construction of the clasping structures 12, 13 can be kept relatively simple and the full circumference of the pipe string can be gripped providing sufficient traction for the transfer of large torques at relatively low normal pressures. The surface pressure required to achieve a desired traction can further be reduced by providing the clasping structures 12, 13 with large jaw surfaces.

As the pipe coupling unit 11 and the pipe handler 34 move upward, the uppermost pipe section of the pipe string is guided by the gripper 42 and the pawls 23 of the pipe coupling unit 11. As the pipe coupling unit reaches the coupling end portion of the pipe section, which has a slightly larger diameter, the pawls 23 are resiliently pushed back.

It is observed that in the present example, the pipe string is oriented vertically, but that the pipe string can also be oriented in a slanting or even horizontal orientation.

Figure 8:
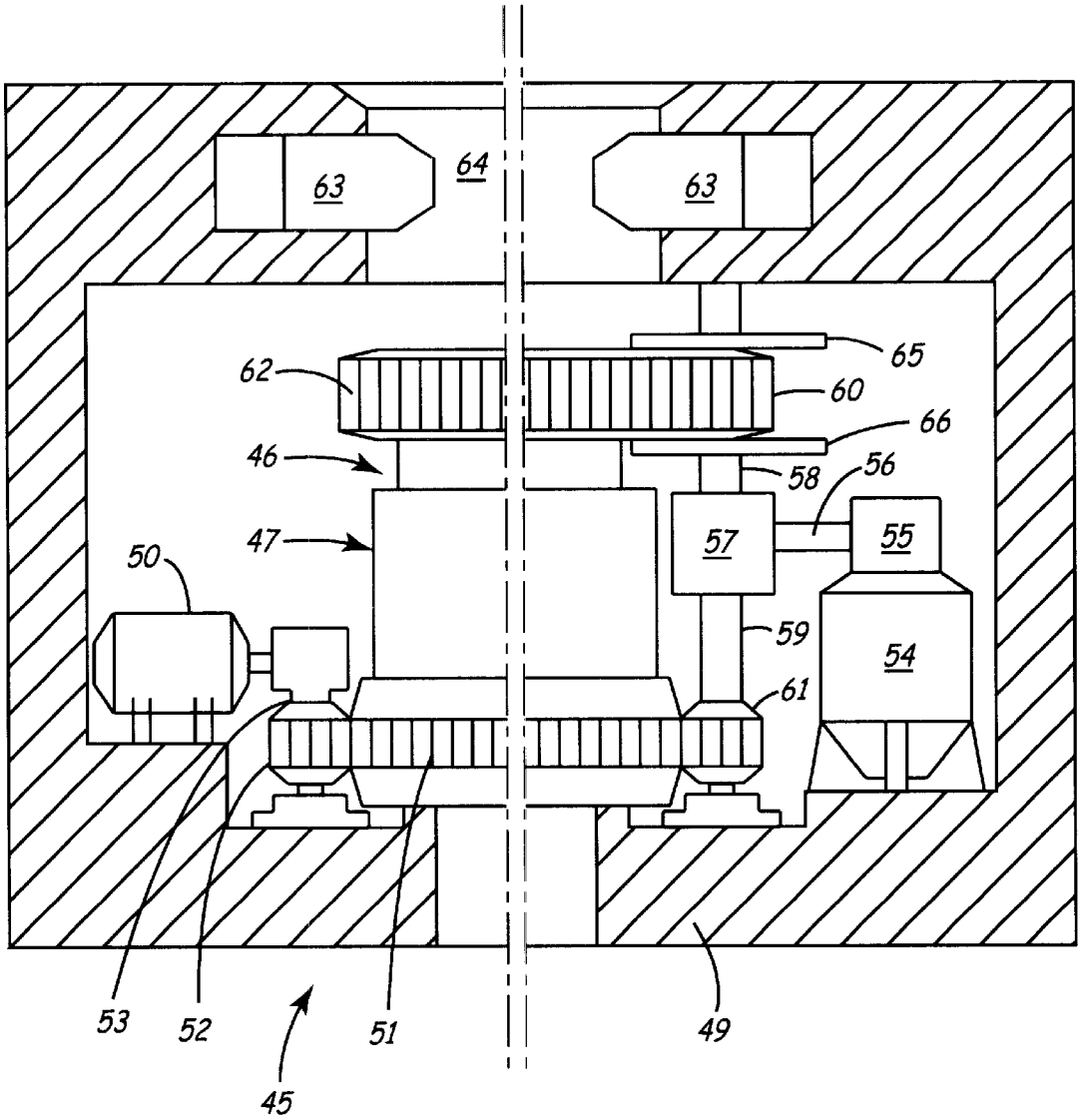
FIG. 8 is an interrupted cross-sectional side view of another example of a pipe coupling unit according to the invention.

In FIG. 8, an alternative example 45 of a pipe coupling unit is shown. The pipe coupling unit 45 according to this example has a pipe section clasping structure 46 for engaging the pipe section 1 which is axially movable relative to and guided by an upper portion of a pipe string clasping structure 47 for engaging the pipe string 2. The axial movement can be carried out in accordance with the rotation imparted by the motor 54 and the pitch of the pipe couplings, so that relative rotation of the pipe section clasping structure 46 relative to the pipe string clasping structure 47 is associated to substantially the same axial displacement relative tot he pipe string 2 as the pipe section 1.

Each time a pipe section has been connected or disconnected, the pipe section clasping structure 46 is rotated and thereby screwed back to its respective starting position.

The pipe string clasping structure 47 is rotatably supported by a rotationally stationary support structure 49.

For rotating the pipe string clasping structure 47, a pipe string drive including a drive motor 50 coupled to the pipe string clasping structure 47 and to the rotationally fixed support structure 49 is provided. The pipe string drive further includes a toothed ring 51 provided on the pipe string clasping structure 13 and a gear wheel 52 meshing therewith and fixed to a drive line 53 of the pipe string drive. In the drive line, a corner transmission 55 is included for bring rotation imparted by the motor 50 into line with the axis of rotation of the pipe string 2.

To drive the rotation of the pipe section clasping structure 46 relative to the pipe string clasping structure 47, a pipe section drive includes a second electromotor 54 and a transmission chain with a corner transmission 55, a drive shaft 56, a distributing transmission 57, further drive shafts 58, 59, gear wheels 60,61 mounted to respectively the drive shafts 58, 59 and toothed rings 51, 62 meshing with, respectively, the gear wheels 60, 61.

The distribution transmission 57 is adapted for driving the drive shaft 58 projecting in one direction in a sense of rotation which is opposite to the sense of rotation in which the drive shaft 59 projecting in the diametrically opposite direction is driven, but does not substantially influence rotation of the drive shafts 58,59 in unison. To this end, the distribution transmission 57 is provided in the form of a differential gear with a reversing transmission for one of the drive shafts 58,59.

The torques applied to the two drive shafts are substantially identical, as are the diameters of the gear wheels 60, 61 and of the toothed rings 51, 62. Thus, if the motor 54 is driven and exerts a torque on the pipe section clasping structure 46, a reactive torque of substantially identical magnitude is exerted on the pipe string clasping structure 47. Accordingly, the reactive torque is passed to the pipe string without affecting the motor 50 which drives the continuous rotation of the pipe string 2 and velocity surges of the pipe string 2 are, at least for a major part, avoided.

The gear wheel 60 meshing with the toothed ring 62 of the pipe section clasping structure 46 is slidably mounted to the drive shaft 58 to allow it to follow axial displacement of the toothed ring as it is screwed into or out of the pipe string clasping structure 47. To ensure that the gear wheel 60 follows the axial movement of the toothed ring 62 accurately, guide discs 65, 66 are mounted to the gear wheels on opposite sides thereof and coaxial therewith. These guide discs project radially beyond the gear wheel 60 and overlap side surfaces of a flange on which the toothed ring 62 of the pipe section clasping structure 46 is located.

For guiding a pipe stem as the pipe coupling unit 45 is moved upward along a newly connected pipe section, guide blocks 63 are provided above the pipe section clasping structure 46 and around a passage 64 for the pipe sections. These guide blocks 63 are resiliently urged against the pipe stems by springs 65 and align a newly connected pipe section 1 with the pipe string 2 until its free end is engaged by the pipe string clasping structure 47. Vice versa, when pipe sections 1 are to be removed from a pipe string 2, the guide blocks 63 provide alignment after a pipe section has been released by the pipe string clasping unit 47 and until it is engaged by the pipe section clasping structure of the pipe handler.

It will be readily apparent to the skilled person that, although the above examples relate to the drilling and lining of oil and gas wells, accordingly adapted modes of carrying out the present invention can also be used in connection with other ground drilling operations.

What is claimed is:

1. A method for making or breaking a coupling between a pipe section and a pipe string projecting from a rotary drilling rig into a bore hole in a lithosphere, in which the pipe section is rotated relative to the pipe string by applying a torque up to a make-up or breaking torque, exertion of said torque generates a reactive torque in an opposite sense of rotation, wherein rotation imparted by a motor is transferred to said pipe string so that said pipe string is rotated as well, and wherein said reactive torque is transferred to said pipe string along a path bypassing said motor.

2. A method according to claim 1, wherein said pipe section to be coupled to said pipe string is accelerated to substantially a rotational velocity at which the pipe string is rotating before said make-up or breaking torque is applied.

3. A method according to claim 1, wherein said pipe section to be coupled to said pipe string is accelerated to substantially a rotational velocity at which the pipe string is rotating and subsequently a pipe section engaging structure for applying said torque to said pipe section to brought into engagement with said pipe section.

4. A method according to claim 1, further including:

subsequent to the coupling of said pipe section to said pipe string, the step of axially moving a pipe coupling unit by which said make-up torque and said reactive torque have been applied towards a proximal end of the pipe string lengthened by said pipe section; and subsequently coupling a next pipe section to the pipe string including the steps of engaging said proximal end of said lengthened pipe string and exerting said reactive torque on said lengthened pipe string by said pipe coupling unit.

5. A pipe coupling unit for at least coupling or uncoupling a pipe section and a pipe string axially projecting from a rotary drilling rig into a bore hole in the lithosphere, comprising:

a pipe string engaging structure for engaging the pipe string;

a pipe section engaging structure for engaging the pipe section, said pipe section engaging structure being coaxial with and rotatable relative to said pipe string engaging structure and in a position axially different from the position of said pipe string engaging structure;

a rotationally stationary support structure rotatably supporting said pipe string engaging structure;

a pipe string drive including a drive motor operatively coupled to said pipe string engaging structure and to said rotationally fixed support structure for driving rotation of said pipe string engaging structure relative to said rotationally fixed support structure; and a pipe section drive for driving rotation of said pipe section engaging structure relative to said pipe string engaging structure with a torque up to a required make-up or breaking torque, said pipe section drive being arranged for transferring a reactive torque in response to said torque up to a required make-up or breaking torque to said pipe string engaging structure along a transfer path bypassing said motor for driving rotation of said pipe string engaging structure.

6. A pipe coupling unit according to claim 5, wherein said engaging structures each form a closed ring structure fully encircling a passage for receiving a pipe to be engaged.

7. A pipe coupling unit accord to claim 5, wherein said pipe section drive includes a second motor, separate from said first motor for driving rotation of said pipe string engaging structure, for rotating said pipe section with a torque up to said make-up or breaking torque.

8. A pipe coupling unit accord to claim 7, wherein said second motor is supported by a rotatable support structure connected to said pipe string engaging structure for rotation in unison therewith.

9. A pipe coupling unit according to claim 8, wherein said rotatable support structure and said rotationally stationary support structure are provided with sliding contacts co-operating along a circular task.

10. A pipe coupling unit according to claim 5, further including a pipe handler for transferring pipe sections from a dispenser to a proximal end of said pipe string projecting into said bore hole in the lithosphere and vice versa, including a pipe section engagement structure for releasably engaging pipe sections to be transferred, a guide and drive structure for moving said pipe section engagement structure between a position adjacent said dispenser and a position and orientation in-line with said pipe string and a drive connected to said pipe section engaging structure for driving rotation of said pipe section engagement structure.

11. A pipe coupling unit according to claim 10, wherein said guide and drive structure is further adapted for moving said pipe section engagement structure in a direction in which, in operative condition, said pipe sections are oriented when held in-line with said pipe string.

* * * * *